US009410449B2

(12) United States Patent
Held et al.

(10) Patent No.: US 9,410,449 B2
(45) **Date of Patent: *Aug. 9, 2016**

(54) DRIVEN STARTER PUMP AND START SEQUENCE

(71) Applicants: Timothy James Held, Akron, OH (US); Michael Vermeersch, Hamilton, OH (US); Tao Xie, Copley, OH (US)

(72) Inventors: Timothy James Held, Akron, OH (US); Michael Vermeersch, Hamilton, OH (US); Tao Xie, Copley, OH (US)

(73) Assignee: Echogen Power Systems, LLC, Akron, OH (US)

( * ) Notice: Subject to any disclaimer, the term of this patent is extended or adjusted under 35 U.S.C. 154(b) by 184 days.

This patent is subject to a terminal disclaimer.

(21) Appl. No.: 14/102,677

(22) Filed: Dec. 11, 2013

(65) Prior Publication Data

US 2014/0096521 A1 Apr. 10, 2014

Related U.S. Application Data

(63) Continuation of application No. 13/205,082, filed on Aug. 8, 2011, now Pat. No. 8,616,001.

(60) Provisional application No. 61/417,789, filed on Nov. 29, 2010.

(51) Int. Cl.

| | |
|---|---|
| ***F01K 13/02*** | (2006.01) |
| ***F01K 13/00*** | (2006.01) |
| ***F01K 7/32*** | (2006.01) |

(Continued)

(52) U.S. Cl.

CPC ..... *F01K 13/02* (2013.01); *F01K 23/04* (2013.01); *F01K 25/10* (2013.01); *F01K 25/103* (2013.01); *F22B 35/086* (2013.01)

(58) Field of Classification Search

CPC ..... F01K 13/02; F01K 23/04; F01K 25/10; F01K 25/103; F22B 35/086

USPC ..... 60/646, 645, 647

See application file for complete search history.

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |

(Continued)

FOREIGN PATENT DOCUMENTS

| | | | |
|---|---|---|---|
| CA | 2794150 | A1 | 11/2011 |
| CN | 1165238 | A | 11/1997 |

(Continued)

OTHER PUBLICATIONS

PCT/US2010/044681—International Search Report and Written Opinion dated Oct. 7, 2010, 10 pages.

(Continued)

*Primary Examiner* — Thai Ba Trieu
*Assistant Examiner* — Deming Wan
(74) *Attorney, Agent, or Firm* — Edmonds & Nolte, PC

(57) ABSTRACT

Aspects of the disclosure generally provide a heat engine system with a working fluid circuit and a method for starting a turbopump disposed in the working fluid circuit. The turbopump has a main pump and may be started and ramped-up using a starter pump arranged in parallel with the main pump of the turbopump. Once the turbopump reaches a self-sustaining speed of operation, a series of valves may be manipulated to deactivate the starter pump and direct additional working fluid to a power turbine for generating electrical power.

20 Claims, 5 Drawing Sheets

(51) Int. Cl.

| | |
|---|---|
| ***F01K 25/10*** | (2006.01) |
| ***F01K 23/04*** | (2006.01) |
| ***F22B 35/08*** | (2006.01) |

(56) References Cited

U.S. PATENT DOCUMENTS

| | | | |
|---|---|---|---|
| 2,691,280 | A | 10/1954 | Albert |
| 3,095,274 | A | 6/1963 | Crawford |
| 3,105,748 | A | 10/1963 | Stahl |
| 3,237,403 | A | 3/1966 | Feher |
| 3,277,955 | A | 10/1966 | Laszlo |
| 3,401,277 | A | 9/1968 | Larson |
| 3,622,767 | A | 11/1971 | Koepcke |
| 3,630,022 | A | 12/1971 | Jubb |
| 3,736,745 | A | 6/1973 | Karig |
| 3,772,879 | A | 11/1973 | Engdahl |
| 3,791,137 | A | 2/1974 | Jubb |
| 3,830,062 | A | 8/1974 | Morgan et al. |
| 3,939,328 | A | 2/1976 | Davis |
| 3,971,211 | A | 7/1976 | Wethe |
| 3,982,379 | A | 9/1976 | Gilli |
| 3,998,058 | A | 12/1976 | Park |
| 4,009,575 | A | 3/1977 | Hartman, Jr. |
| 4,029,255 | A | 6/1977 | Heiser |
| 4,030,312 | A | 6/1977 | Wallin |
| 4,049,407 | A | 9/1977 | Bottum |
| 4,070,870 | A | 1/1978 | Bahel |
| 4,099,381 | A | 7/1978 | Rappoport |
| 4,119,140 | A | 10/1978 | Cates |
| 4,150,547 | A | 4/1979 | Hobson |
| 4,152,901 | A | 5/1979 | Munters |
| 4,164,848 | A | 8/1979 | Gilli |
| 4,164,849 | A | 8/1979 | Mangus |
| 4,170,435 | A | 10/1979 | Swearingen |
| 4,182,960 | A | 1/1980 | Reuyl |
| 4,183,220 | A | 1/1980 | Shaw |
| 4,198,827 | A | 4/1980 | Terry et al. |
| 4,208,882 | A | 6/1980 | Lopes |
| 4,221,185 | A | 9/1980 | Scholes |
| 4,233,085 | A | 11/1980 | Roderick |
| 4,236,869 | A | 12/1980 | Laurello |
| 4,248,049 | A | 2/1981 | Briley |
| 4,257,232 | A | 3/1981 | Bell |
| 4,287,430 | A | 9/1981 | Guido |
| 4,336,692 | A | 6/1982 | Ecker |
| 4,347,711 | A | 9/1982 | Noe |
| 4,347,714 | A | 9/1982 | Kinsell |
| 4,372,125 | A | 2/1983 | Dickenson |
| 4,384,568 | A | 5/1983 | Palmatier |
| 4,391,101 | A | 7/1983 | Labbe |
| 4,420,947 | A | 12/1983 | Yoshino |
| 4,428,190 | A | 1/1984 | Bronicki |
| 4,433,554 | A | 2/1984 | Rojey |
| 4,439,687 | A | 3/1984 | Wood |
| 4,439,994 | A | 4/1984 | Briley |
| 4,448,033 | A | 5/1984 | Briccetti |
| 4,450,363 | A | 5/1984 | Russell |
| 4,455,836 | A | 6/1984 | Binstock |
| 4,467,609 | A | 8/1984 | Loomis |
| 4,467,621 | A | 8/1984 | O'Brien |
| 4,475,353 | A | 10/1984 | Lazare |
| 4,489,562 | A | 12/1984 | Snyder |
| 4,489,563 | A | 12/1984 | Kalina |
| 4,498,289 | A | 2/1985 | Osgerby |
| 4,516,403 | A | 5/1985 | Tanaka |
| 4,538,960 | A | 9/1985 | Iino et al. |
| 4,549,401 | A | 10/1985 | Spliethoff |
| 4,555,905 | A | 12/1985 | Endou |
| 4,558,228 | A | 12/1985 | Larjola |
| 4,573,321 | A | 3/1986 | Knaebel |
| 4,578,953 | A | 4/1986 | Krieger |
| 4,589,255 | A | 5/1986 | Martens |
| 4,636,578 | A | 1/1987 | Feinberg |
| 4,674,297 | A | 6/1987 | Vobach |
| 4,694,189 | A | 9/1987 | Haraguchi |
| 4,697,981 | A | 10/1987 | Brown et al. |
| 4,700,543 | A | 10/1987 | Krieger |
| 4,730,977 | A | 3/1988 | Haaser |
| 4,756,162 | A | 7/1988 | Dayan |
| 4,765,143 | A | 8/1988 | Crawford |
| 4,773,212 | A | 9/1988 | Griffin |
| 4,798,056 | A | 1/1989 | Franklin |
| 4,813,242 | A | 3/1989 | Wicks |
| 4,821,514 | A | 4/1989 | Schmidt |
| 4,867,633 | A | 9/1989 | Gravelle |
| 4,892,459 | A | 1/1990 | Guelich |
| 4,986,071 | A | 1/1991 | Voss |
| 4,993,483 | A | 2/1991 | Harris |
| 5,000,003 | A | 3/1991 | Wicks |
| 5,050,375 | A | 9/1991 | Dickinson |
| 5,083,425 | A | 1/1992 | Hendriks et al. |
| 5,098,194 | A | 3/1992 | Kuo |
| 5,102,295 | A | 4/1992 | Pope |
| 5,104,284 | A | 4/1992 | Hustak, Jr. |
| 5,164,020 | A | 11/1992 | Wagner |
| 5,176,321 | A | 1/1993 | Doherty |
| 5,203,159 | A | 4/1993 | Koizumi et al. |
| 5,228,310 | A | 7/1993 | Vandenberg |
| 5,291,960 | A | 3/1994 | Brandenburg |
| 5,320,482 | A | 6/1994 | Palmer et al. |
| 5,335,510 | A | 8/1994 | Rockenfeller |
| 5,358,378 | A | 10/1994 | Holscher |
| 5,360,057 | A | 11/1994 | Rockenfeller |
| 5,392,606 | A | 2/1995 | Labinov |
| 5,440,882 | A | 8/1995 | Kalina |
| 5,444,972 | A | 8/1995 | Moore |
| 5,483,797 | A | 1/1996 | Rigal et al. |
| 5,488,828 | A | 2/1996 | Brossard |
| 5,490,386 | A | 2/1996 | Keller |
| 5,503,222 | A | 4/1996 | Dunne |
| 5,531,073 | A | 7/1996 | Bronicki |
| 5,538,564 | A | 7/1996 | Kaschmitter |
| 5,542,203 | A | 8/1996 | Luoma |
| 5,570,578 | A | 11/1996 | Saujet |
| 5,588,298 | A | 12/1996 | Kalina |
| 5,600,967 | A | 2/1997 | Meckler |
| 5,634,340 | A | 6/1997 | Grennan |
| 5,647,221 | A | 7/1997 | Garris, Jr. |
| 5,649,426 | A | 7/1997 | Kalina |
| 5,676,382 | A | 10/1997 | Dahlheimer |
| 5,680,753 | A | 10/1997 | Hollinger |
| 5,738,164 | A | 4/1998 | Hildebrand |
| 5,754,613 | A | 5/1998 | Hashiguchi |
| 5,771,700 | A | 6/1998 | Cochran |
| 5,789,822 | A | 8/1998 | Calistrat |
| 5,813,215 | A | 9/1998 | Weisser |
| 5,833,876 | A | 11/1998 | Schnur |
| 5,862,666 | A | 1/1999 | Liu |
| 5,873,260 | A | 2/1999 | Linhardt |
| 5,874,039 | A | 2/1999 | Edelson |
| 5,894,836 | A | 4/1999 | Wu |
| 5,899,067 | A | 5/1999 | Hageman |
| 5,903,060 | A | 5/1999 | Norton |
| 5,918,460 | A | 7/1999 | Connell |
| 5,941,238 | A | 8/1999 | Tracy |
| 5,943,869 | A | 8/1999 | Cheng |
| 5,946,931 | A | 9/1999 | Lomax |
| 5,973,050 | A | 10/1999 | Johnson |
| 6,037,683 | A | 3/2000 | Lulay |
| 6,041,604 | A | 3/2000 | Nicodemus |
| 6,058,930 | A | 5/2000 | Shingleton |
| 6,062,815 | A | 5/2000 | Holt |
| 6,065,280 | A | 5/2000 | Ranasinghe |
| 6,066,797 | A | 5/2000 | Toyomura |
| 6,070,405 | A | 6/2000 | Jerye |
| 6,082,110 | A | 7/2000 | Rosenblatt |
| 6,105,368 | A | 8/2000 | Hansen |
| 6,112,547 | A | 9/2000 | Spauschus |
| 6,129,507 | A | 10/2000 | Ganelin |
| 6,158,237 | A | 12/2000 | Riffat |
| 6,164,655 | A | 12/2000 | Bothien |
| 6,202,782 | B1 | 3/2001 | Hatanaka |
| 6,223,846 | B1 | 5/2001 | Schechter |
| 6,233,938 | B1 | 5/2001 | Nicodemus |

(56) References Cited

U.S. PATENT DOCUMENTS 6,282,900 B1 9/2001 Bell
6,282,917 B1 9/2001 Mongan
6,295,818 B1 10/2001 Ansley
6,299,690 B1 10/2001 Mongeon
6,341,781 B1 1/2002 Matz
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse et al.
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,553 B2 4/2006 Johnston et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
8,616,001 B2 * 12/2013 Held et al. ..... 60/646
2001/0015061 A1 8/2001 Viteri et al.
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.

(56) References Cited

U.S. PATENT DOCUMENTS

| | | | |
|---|---|---|---|
| 2006/0225421 | A1 | 10/2006 | Yamanaka et al. |
| 2006/0225459 | A1 | 10/2006 | Meyer |
| 2006/0249020 | A1 | 11/2006 | Tonkovich et al. |
| 2006/0254281 | A1 | 11/2006 | Badeer et al. |
| 2007/0001766 | A1 | 1/2007 | Ripley et al. |
| 2007/0017192 | A1 | 1/2007 | Bednarek et al. |
| 2007/0019708 | A1 | 1/2007 | Shiflett et al. |
| 2007/0027038 | A1 | 2/2007 | Kamimura et al. |
| 2007/0056290 | A1 | 3/2007 | Dahm |
| 2007/0089449 | A1 | 4/2007 | Gurin |
| 2007/0108200 | A1 | 5/2007 | McKinzie, II |
| 2007/0119175 | A1 | 5/2007 | Ruggieri et al. |
| 2007/0130952 | A1 | 6/2007 | Copen |
| 2007/0151244 | A1 | 7/2007 | Gurin |
| 2007/0161095 | A1 | 7/2007 | Gurin |
| 2007/0163261 | A1 | 7/2007 | Strathman |
| 2007/0195152 | A1 | 8/2007 | Kawai et al. |
| 2007/0204620 | A1 | 9/2007 | Pronske et al. |
| 2007/0227472 | A1 | 10/2007 | Takeuchi et al. |
| 2007/0234722 | A1 | 10/2007 | Kalina |
| 2007/0245733 | A1 | 10/2007 | Pierson et al. |
| 2007/0246206 | A1 | 10/2007 | Gong et al. |
| 2008/0000225 | A1 | 1/2008 | Kalina |
| 2008/0006040 | A1 | 1/2008 | Peterson et al. |
| 2008/0010967 | A1 | 1/2008 | Griffin et al. |
| 2008/0023666 | A1 | 1/2008 | Gurin |
| 2008/0053095 | A1 | 3/2008 | Kalina |
| 2008/0066470 | A1 | 3/2008 | MacKnight |
| 2008/0135253 | A1 | 6/2008 | Vinegar et al. |
| 2008/0163625 | A1 | 7/2008 | O'Brien |
| 2008/0173450 | A1 | 7/2008 | Goldberg et al. |
| 2008/0211230 | A1 | 9/2008 | Gurin |
| 2008/0250789 | A1 | 10/2008 | Myers et al. |
| 2008/0252078 | A1 | 10/2008 | Myers |
| 2009/0021251 | A1 | 1/2009 | Simon |
| 2009/0085709 | A1 | 4/2009 | Meinke |
| 2009/0107144 | A1 | 4/2009 | Moghtaderi et al. |
| 2009/0139234 | A1 | 6/2009 | Gurin |
| 2009/0139781 | A1 | 6/2009 | Straubel |
| 2009/0173337 | A1 | 7/2009 | Tamaura et al. |
| 2009/0173486 | A1 | 7/2009 | Copeland |
| 2009/0180903 | A1 | 7/2009 | Martin et al. |
| 2009/0205892 | A1 | 8/2009 | Jensen et al. |
| 2009/0211251 | A1 | 8/2009 | Petersen et al. |
| 2009/0211253 | A1 | 8/2009 | Radcliff et al. |
| 2009/0266075 | A1 | 10/2009 | Westmeier et al. |
| 2009/0293503 | A1 | 12/2009 | Vandor |
| 2010/0024421 | A1 | 2/2010 | Litwin |
| 2010/0077792 | A1 | 4/2010 | Gurin |
| 2010/0083662 | A1 | 4/2010 | Kalina |
| 2010/0102008 | A1 | 4/2010 | Hedberg |
| 2010/0122533 | A1 | 5/2010 | Kalina |
| 2010/0146949 | A1 | 6/2010 | Stobart et al. |
| 2010/0146973 | A1 | 6/2010 | Kalina |
| 2010/0156112 | A1 | 6/2010 | Held et al. |
| 2010/0162721 | A1 | 7/2010 | Welch et al. |
| 2010/0205962 | A1 | 8/2010 | Kalina |
| 2010/0218513 | A1 | 9/2010 | Vaisman et al. |
| 2010/0218930 | A1 | 9/2010 | Proeschel |
| 2010/0263380 | A1 | 10/2010 | Biederman et al. |
| 2010/0287934 | A1 | 11/2010 | Glynn et al. |
| 2010/0300093 | A1 | 12/2010 | Doty |
| 2010/0326076 | A1 | 12/2010 | Ast et al. |
| 2011/0027064 | A1 | 2/2011 | Pal et al. |
| 2011/0030404 | A1 | 2/2011 | Gurin |
| 2011/0048012 | A1 | 3/2011 | Ernst et al. |
| 2011/0061384 | A1 | 3/2011 | Held et al. |
| 2011/0061387 | A1 | 3/2011 | Held et al. |
| 2011/0088399 | A1 | 4/2011 | Briesch et al. |
| 2011/0179799 | A1 | 7/2011 | Allam et al. |
| 2011/0185729 | A1 | 8/2011 | Held |
| 2011/0192163 | A1 | 8/2011 | Kasuya |
| 2011/0203278 | A1 | 8/2011 | Kopecek et al. |
| 2011/0259010 | A1 | 10/2011 | Bronicki et al. |
| 2011/0299972 | A1 | 12/2011 | Morris |
| 2011/0308253 | A1 | 12/2011 | Ritter |
| 2012/0047892 | A1 | 3/2012 | Held et al. |
| 2012/0067055 | A1 | 3/2012 | Held |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0159922 | A1 | 6/2012 | Gurin |
| 2012/0159956 | A1 | 6/2012 | Gurin |
| 2012/0174558 | A1 | 7/2012 | Gurin |
| 2012/0186219 | A1 | 7/2012 | Gurin |
| 2012/0247134 | A1 | 10/2012 | Gurin |
| 2012/0247455 | A1 | 10/2012 | Gurin et al. |
| 2012/0261090 | A1 | 10/2012 | Durmaz et al. |
| 2013/0019597 | A1 | 1/2013 | Kalina |
| 2013/0033037 | A1 | 2/2013 | Held et al. |
| 2013/0036736 | A1 | 2/2013 | Hart et al. |
| 2013/0113221 | A1 | 5/2013 | Held |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| EP | 1977174 | A2 | 10/2008 |
| EP | 1998013 | A2 | 12/2008 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | A1 | 1/2013 |
| GB | 856985 | A | 12/1960 |
| GB | 2010974 | A | 7/1979 |
| GB | 2075608 | A | 11/1981 |
| JP | 58-193051 | A | 11/1983 |
| JP | 60-040707 | A | 3/1985 |
| JP | 61-152914 | A | 7/1986 |
| JP | 01-240705 | A | 9/1989 |
| JP | 05-321612 | A | 12/1993 |
| JP | 06-331225 | A | 11/1994 |
| JP | 08-028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11-270352 | | 5/1999 |
| JP | 2000-257407 | A | 9/2000 |
| JP | 2001-193419 | A | 7/2001 |
| JP | 2002-097965 | A | 4/2002 |
| JP | 2003-529715 | A | 10/2003 |
| JP | 2004-239250 | A | 8/2004 |
| JP | 2004-332626 | A | 11/2004 |
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 10-0191080 | | 6/1999 |
| KR | 10-20070086244 | A | 8/2007 |
| KR | 10-0766101 | B1 | 10/2007 |
| KR | 10-0844634 | A | 7/2008 |
| KR | 10-20100067927 | A | 6/2010 |
| KR | 10-20110018769 | A | 2/2011 |
| KR | 1069914 | B1 | 9/2011 |
| KR | 1103549 | B1 | 1/2012 |
| KR | 10-20120058582 | A | 6/2012 |
| KR | 2012-0068670 | A | 6/2012 |
| KR | 2012-0128753 | A | 11/2012 |
| KR | 2012-0128755 | A | 11/2012 |
| WO | 91-05145 | A1 | 4/1991 |
| WO | 96-09500 | A1 | 3/1996 |

(56) References Cited

FOREIGN PATENT DOCUMENTS

| | | | |
|---|---|---|---|
| WO | 00-71944 | A1 | 11/2000 |
| WO | 01-44658 | A1 | 6/2001 |
| WO | 2006-060253 | A1 | 6/2006 |
| WO | 2006-137957 | A1 | 12/2006 |
| WO | 2007-056241 | A2 | 5/2007 |
| WO | 2007-079245 | A2 | 7/2007 |
| WO | 2007-082103 | A2 | 7/2007 |
| WO | 2007-112090 | A2 | 10/2007 |
| WO | 2008-039725 | A2 | 4/2008 |
| WO | 2008-101711 | A2 | 8/2008 |
| WO | 2009-045196 | A1 | 4/2009 |
| WO | 2009-058992 | A2 | 5/2009 |
| WO | 2010-074173 | A1 | 7/2010 |
| WO | 2010-083198 | A1 | 7/2010 |
| WO | 2010-121255 | A1 | 10/2010 |
| WO | 2010-126980 | A2 | 11/2010 |
| WO | 2010-151560 | A1 | 12/2010 |
| WO | 2011-017450 | A2 | 2/2011 |
| WO | 2011-017476 | A1 | 2/2011 |
| WO | 2011-017599 | A1 | 2/2011 |
| WO | 2011-034984 | A1 | 3/2011 |
| WO | 2011-094294 | A2 | 8/2011 |
| WO | 2011-119650 | A2 | 9/2011 |
| WO | 2012-074905 | A2 | 6/2012 |
| WO | 2012-074907 | A2 | 6/2012 |
| WO | 2012-074911 | A2 | 6/2012 |
| WO | 2012-074940 | A2 | 6/2012 |
| WO | 2013-055391 | A1 | 4/2013 |
| WO | 2013-059687 | A1 | 4/2013 |
| WO | 2013-059695 | A1 | 4/2013 |
| WO | 2013-070249 | A1 | 5/2013 |
| WO | 2013-074907 | A1 | 5/2013 |

OTHER PUBLICATIONS

PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2011/062266—International Search Report and Written Opinion dated Jul. 9, 2012, 12 pages.
PCT/US2011/062198—International Search Report and Written Opinion dated Jul. 2, 2012, 9 pages.
PCT/US2011/062198—Extended European Search Report dated May 6, 2014, 9 pages.
PCT/US2011/062201—International Search Report and Written Opinion dated Jun. 26, 2012, 9 pages.
PCT/US2011/062201—Extended European Search Report dated May 28, 2014, 8 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/013154—International Search Report dated May 23, 2014, 4 pages.
PCT/US2014/013170—Notification of Transmittal of the International Search Report and the Written Opinion of the International Searching Authority, or the Declaration, dated May 9, 2014, 12 pages.
PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Persichilli, Michael, et al., "Supercritical CO2 Power Cycle Developments and Commercialization: Why SCO2 can Displace Steam", Echogen Power Systems, LLC, Power-Gen India & Central Asia 2012, Apr. 19-21, 2012, New Delhi, India, 15 pages.
Renz, Manfred, "The New Generation Kalina Cycle", Contribution to the Conference: Electricity Generation from Enhanced Geothermal Systems, Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J. and Bhattacharyya, Souvik, "Optimization of Recompression S-CO2 Power Cycle with Reheating", Energy Conversion and Management 50, May 17, 2009, pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
VGB Powertech Service Gmbh, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, 1 page, (Abstract Only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle Coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle Coupled with Small Modular Water Cooled Reactor", Paper, Korea Advanced Institute of Science and Technology and Khalifa University of Science, Technology and Research, May 24-25, 2011, Boulder, CO, 7 pages.

(56) References Cited

OTHER PUBLICATIONS

Alpy, N., et al., "French Atomic Energy Commission views as regards to SCO2 Cycle Development priorities and related R&D approach", Presentation, Symposium on SCO2 Power Cycles, Apr. 29-30, 2009, Troy, NY, 20 pages.
Angelino, G. and Invernizzi, C.M., "Carbon Dioxide Power Cycles using Liquid Natural Gas as Heat Sink", Applied Thermal Engineering, Mar. 3, 2009, 43 pages.
Bryant, John C., Saari, Henry, and Zanganeh, Kourosh, "An Analysis and Comparison of the Simple and Recompression Supercritical CO2 Cycles", Supercritical CO2 Power Cycle Symposium, May 24-25, 2011, Boulder, CO, 8 pages.
Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.
Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.
Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.
Chen, Yang, "Thermodynamic Cycles Using Carbon Dioxide as Working Fluid", Doctoral Thesis, School of Industrial Engineering and Management, Stockholm, Oct. 2011, 150 pages, (3 parts).
Chinese Search Report for Application No. 201080035382.1, 2 pages.
Chinese Search Report for Application No. 201080050795.7, 2 pages.
Chordia, Lalit, "Optimizing Equipment for Supercritical Applications", Thar Energy LLC, Supercritical CO2 Power Cycle Symposium, May 24-25, 2011, Boulder, CO, 7 pages.
Combs, Osie V., "An Investigation of the Supercritical CO2 Cycle (Feher cycle) for Shipboard Application", Massachusetts Institute of Technology, May 1977, 290 pages.
Di Bella, Francis A., "A Gas Turbine Engine Exhaust Waste Heat Recovery Navy Shipboard Module Development", Supercritical CO2 Power Cycle Symposium, May 24-25, 2011, Boulder, CO, 8 pages.
Dostal, V., et al., "A Supercritical Carbon Dioxide Cycle for Next Generation Nuclear Reactors", Mar. 10, 2004, 326 pages, (7 parts).
Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, Troy, NY, 8 pages.
Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.
Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.
Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.
Feher, E.G., et al. "Investigation of Supercritical (Feher) Cycle", Astropower Laboratory, Missile & Space Systems Division, Oct. 1968, 152 pages.
Fuller, Robert L. and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.
Fuller, Robert L. and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.
Gokhstein, D.P. and Verkhivker, G.P., "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P., Taubman, E.I., Konyaeva, G.P., "Thermodynamic Cycles of Carbon Dioxide Plant with an Additional Turbine After the Regenerator", Energy Citations Database, Mar. 1973, 1 page, Abstract only.
Hejzlar, R, et al., "Assessment of Gas Cooled Gas Reactor with Indirect Supercritical CO2 Cycle", Massachusetts Institute of Technology, Jan. 2006, 10 pages.
Hoffman, John R. and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A. & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, 1 page, (Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for S-CO2 Gas Turbine Power Plants", Master of Science Thesis, Delft University of Technology, Oct. 2012, 122 pages, (3 parts).

(56) References Cited

OTHER PUBLICATIONS

Oh, Chang, et al., "Development of a Supercritical Carbon Dioxide Brayton Cycle: Improving PBR Efficiency and Testing Material Compatibility", Presentation, Nuclear Energy Initiative Report, Oct. 2004, 38 pages.
Oh, Chang, et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept", Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/0131614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and the Written Opinion of the International Searching Authority, or the Declaration dated Sep. 1, 2010, 6 pages.
PCT/US2010/044476—International Search Report dated Sep. 29, 2010, 23 pages.

* cited by examiner

DRIVEN STARTER PUMP AND START SEQUENCE

CROSS-REFERENCE TO RELATED APPLICATIONS

This application is a continuation of U.S. application Ser. No. 13/205,082, entitled "Driven Starter Pump and Start Sequence," and filed on Aug. 8, 2011, which claims benefit of U.S. Prov. Appl. No. 61/417,789, entitled "Parallel Cycle Heat Engines," and filed on Nov. 29, 2010, and which claims priority to PCT Appl. No. US2011/029486, entitled "Heat Engines with Cascade Cycles," and filed on Mar. 22, 2011, the contents of which are hereby incorporated by reference to the extent not inconsistent with the present disclosure.

BACKGROUND

Heat is often created as a byproduct of industrial processes where flowing streams of high-temperature liquids, solids, or gases must be exhausted into the environment or removed in some way in an effort to maintain the operating temperatures of the industrial process equipment. Sometimes the industrial process can use heat exchanger devices to capture the heat and recycle it back into the process via other process streams. Other times it is not feasible to capture and recycle this heat either because its temperature is too high or it may contain insufficient mass flow. This heat is referred to as "waste" heat and is typically discharged directly into the environment or indirectly through a cooling medium, such as water or air.

This waste heat can be converted into useful work by a variety of turbine generator systems that employ well-known thermodynamic methods, such as the Rankine cycle. These thermodynamic methods are typically steam-based processes where the waste heat is recovered and used to generate steam from water in a boiler in order to drive a corresponding turbine. Organic Rankine cycles replace the water with a lower boiling-point working fluid, such as a light hydrocarbon like propane or butane, or a HCFC (e.g., R245fa) fluid. More recently, and in view of issues such as thermal instability, toxicity, or flammability of the lower boiling-point working fluids, some thermodynamic cycles have been modified to circulate more greenhouse-friendly and/or neutral working fluids, such as carbon dioxide or ammonia.

A pump is required to pressurize and circulate the working fluid throughout the working fluid circuit. The pump is typically a motor-driven pump, however, these pumps require costly shaft seals to prevent working fluid leakage and often require the implementation of a gearbox and a variable frequency drive which add to the overall cost and complexity of the system. Replacing the motor-driven pump with a turbopump eliminates one or more of these issues, but at the same time introduces problems of starting and "bootstrapping" the turbopump, which relies heavily on the circulation of heated working fluid for proper operation. Unless the turbopump is provided with a successful start sequence, the turbopump will not be able to bootstrap itself and thereafter attain steady-state operation.

What is needed, therefore, is a system and method of operating a waste heat recovery thermodynamic cycle that provides a successful start sequence adapted to start a turbopump and bring it to steady-state operation.

SUMMARY

Embodiments of the disclosure may provide a heat engine system for converting thermal energy into mechanical energy.

The heat engine system may include a turbopump comprising a main pump operatively coupled to a drive turbine and hermetically-sealed within a casing, the main pump being configured to circulate a working fluid throughout a working fluid circuit, wherein the working fluid is separated in the working fluid circuit into a first mass flow and a second mass flow. The heat engine system may also include a first heat exchanger in fluid communication with the main pump and in thermal communication with a heat source, the first heat exchanger being configured to receive the first mass flow and transfer thermal energy from the heat source to the first mass flow. The heat engine system may further include a power turbine fluidly coupled to the first heat exchanger and configured to expand the first mass flow, a first recuperator fluidly coupled to the power turbine and configured to receive the first mass flow discharged from the power turbine, and a second recuperator fluidly coupled to the drive turbine, the drive turbine being configured to receive and expand the second mass flow and discharge the second mass flow into the second recuperator. Moreover, the heat engine system may include a starter pump arranged in parallel with the main pump in the working fluid circuit, a first recirculation line fluidly coupling the main pump with a low pressure side of the working fluid circuit and a second recirculation line fluidly coupling the starter pump with the low pressure side of the working fluid circuit.

Embodiments of the disclosure may further provide a method for starting a turbopump in a thermodynamic working fluid circuit. The exemplary method may include circulating a working fluid in the working fluid circuit with a starter pump, the starter pump being in fluid communication with a first heat exchanger that is in thermal communication with a heat source, transferring thermal energy to the working fluid from the heat source in the first heat exchanger, and expanding the working fluid in a drive turbine fluidly coupled to the first heat exchanger, the drive turbine being operatively coupled to a main pump, where the drive turbine and the main pump comprise the turbopump. The method may further include driving the main pump with the drive turbine, diverting the working fluid discharged from the main pump into a first recirculation line fluidly communicating the main pump with a low pressure side of the working fluid circuit, the first recirculation line having a first bypass valve arranged therein, and closing the first bypass valve as the turbopump reaches a self-sustaining speed of operation. The method may also include circulating the working fluid discharged from the main pump through the working fluid circuit, deactivating the starter pump and opening a second bypass valve arranged in a second recirculation line fluidly communicating the starter pump with the low pressure side of the working fluid circuit, and diverting the working fluid discharged from the starter pump into the second recirculation line.

Embodiments of the disclosure may further provide another exemplary heat engine system for converting thermal energy into mechanical energy. The heat engine system may include a turbopump including a main pump operatively coupled to a drive turbine and hermetically-sealed within a casing, the main pump being configured to circulate a working fluid throughout a working fluid circuit, a starter pump arranged in parallel with the main pump in the working fluid circuit, and a first check valve arranged in the working fluid circuit downstream from the main pump. The heat engine system may also include a second check valve arranged in the working fluid circuit downstream from the starter pump and fluidly coupled to the first check valve, a power turbine fluidly coupled to both the main pump and the starter pump, and a shut-off valve arranged in the working fluid circuit to divert the working fluid around the power turbine. The heat engine system may further include a first recirculation line fluidly coupling the main pump with a low pressure side of the working fluid circuit, and a second recirculation line fluidly coupling the starter pump with the low pressure side of the working fluid circuit.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
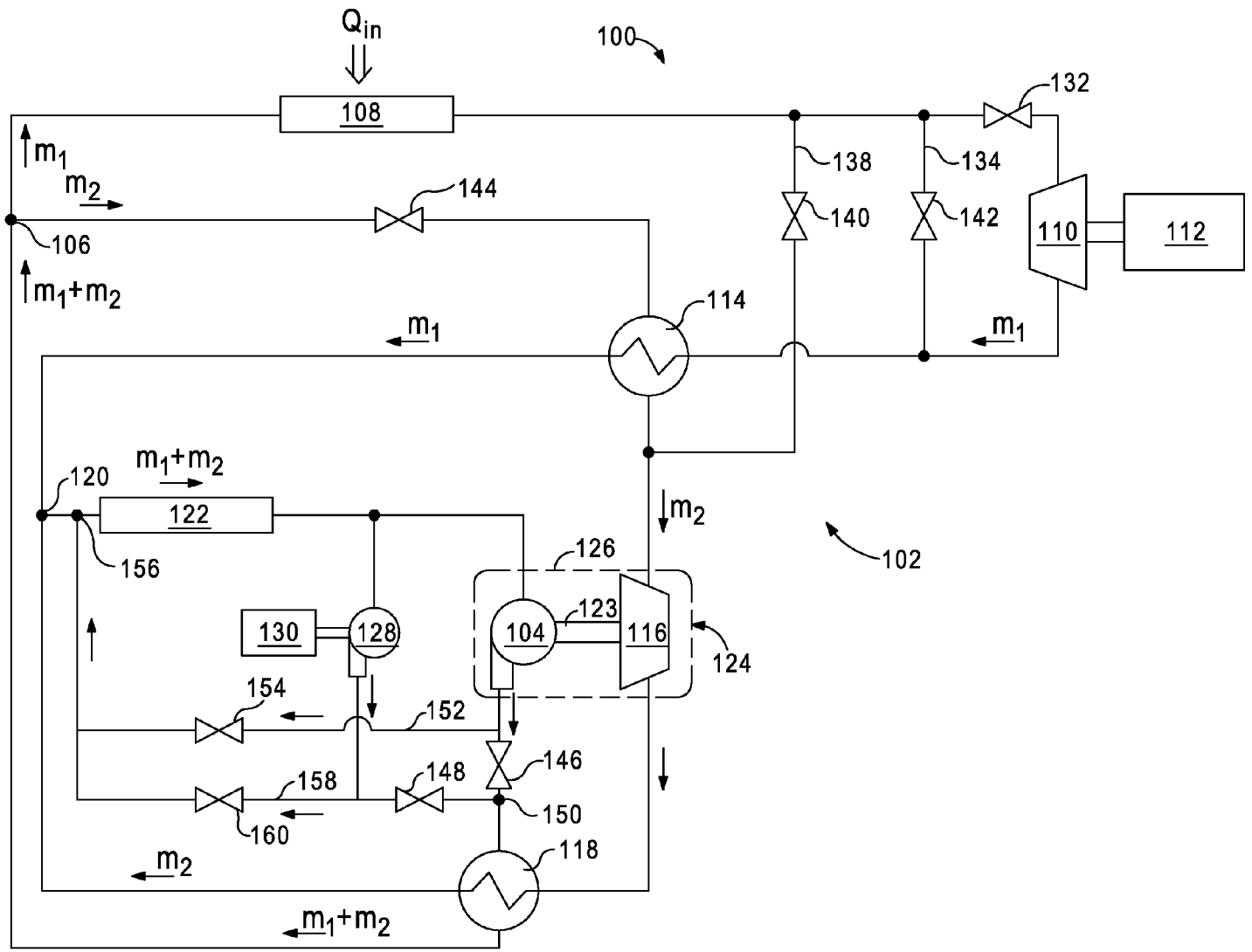
FIG. 1 illustrates a schematic of a cascade thermodynamic waste heat recovery cycle, according to one or more embodiments disclosed.

It is to be understood that the following disclosure describes several exemplary embodiments for implementing different features, structures, or functions of the inventions. Exemplary embodiments of components, arrangements, and configurations are described below to simplify the present disclosure; however, these exemplary embodiments are provided merely as examples and are not intended to limit the scope of the inventions. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the inventions, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary heat engine system 100, which may also be referred to as a thermal engine, a power generation device, a heat or waste heat recovery system, and/or a heat to electricity system. The heat engine system 100 may encompass one or more elements of a Rankine thermodynamic cycle configured to produce power from a wide range of thermal sources. The terms "thermal engine" or "heat engine" as used herein generally refer to the equipment set that executes the various thermodynamic cycle embodiments described herein. The term "heat recovery system" generally refers to the thermal engine in cooperation with other equipment to deliver/remove heat to and from the thermal engine.

The heat engine system 100 may operate as a closed-loop thermodynamic cycle that circulates a working fluid throughout a working fluid circuit 102. As illustrated, the heat engine system 100 may be characterized as a "cascade" thermodynamic cycle, where residual thermal energy from expanded working fluid is used to preheat additional working fluid before its respective expansion. Other exemplary cascade thermodynamic cycles that may also be implemented into the present disclosure may be found in PCT Pat. App. No. U.S.2011/29486, entitled "Heat Engines with Cascade Cycles," filed on Mar. 22, 2011, and published as WO2011119650 (A2), the contents of which are hereby incorporated by reference. The working fluid circuit 102 is defined by a variety of conduits adapted to interconnect the various components of the heat engine system 100. Although the heat engine system 100 may be characterized as a closed-loop cycle, the heat engine system 100 as a whole may or may not be hermetically-sealed such that no amount of working fluid is leaked into the surrounding environment.

In one or more embodiments, the working fluid used in the heat engine system 100 may be carbon dioxide ($CO_2$). It should be noted that use of the term $CO_2$ is not intended to be limited to $CO_2$ of any particular type, purity, or grade. For example, industrial grade $CO_2$ may be used without departing from the scope of the disclosure. In other embodiments, the working fluid may a binary, ternary, or other working fluid blend. For example, a working fluid combination can be selected for the unique attributes possessed by the combination within a heat recovery system, as described herein. One such fluid combination includes a liquid absorbent and $CO_2$ mixture enabling the combination to be pumped in a liquid state to high pressure with less energy input than required to compress $CO_2$. In other embodiments, the working fluid may be a combination of $CO_2$ and one or more other miscible fluids. In yet other embodiments, the working fluid may be a combination of $CO_2$ and propane, or $CO_2$ and ammonia, without departing from the scope of the disclosure.

Use of the term "working fluid" is not intended to limit the state or phase of matter that the working fluid is in. For instance, the working fluid may be in a fluid phase, a gas phase, a supercritical phase, a subcritical state or any other phase or state at any one or more points within the heat engine system 100 or thermodynamic cycle. In one or more embodiments, the working fluid is in a supercritical state over certain portions of the heat engine system 100 (i.e., a high pressure side), and in a subcritical state at other portions of the heat engine system 100 (i.e., a low pressure side). In other embodiments, the entire thermodynamic cycle may be operated such that the working fluid is maintained in either a supercritical or subcritical state throughout the entire working fluid circuit 102.

The heat engine system 100 may include a main pump 104 for pressurizing and circulating the working fluid throughout the working fluid circuit 102. In its combined state, and as used herein, the working fluid may be characterized as $m_1+m_2$, where $m_1$ is a first mass flow and $m_2$ is a second mass flow, but where each mass flow $m_1$, $m_2$ is part of the same working fluid mass coursing throughout the working fluid circuit 102.

After being discharged from the main pump 104, the combined working fluid $m_1+m_2$ is split into the first and second mass flows $m_1$ and $m_2$, respectively, at point 106 in the working fluid circuit 102. The first mass flow $m_1$ is directed to a heat exchanger 108 in thermal communication with a heat source $Q_{in}$. The heat exchanger 108 may be configured to increase the temperature of the first mass flow $m_1$. The respective mass flows $m_1$, $m_2$ may be controlled by the user, control system, or by the configuration of the system, as desired.

The heat source $Q_{in}$ may derive thermal energy from a variety of high temperature sources. For example, the heat source $Q_{in}$ may be a waste heat stream such as, but not limited to, gas turbine exhaust, process stream exhaust, or other combustion product exhaust streams, such as furnace or boiler exhaust streams. Accordingly, the thermodynamic cycle 100 may be configured to transform waste heat into electricity for applications ranging from bottom cycling in gas turbines, stationary diesel engine gensets, industrial waste heat recovery (e.g., in refineries and compression stations), and hybrid alternatives to the internal combustion engine. In other embodiments, the heat source $Q_{in}$ may derive thermal energy from renewable sources of thermal energy such as, but not limited to, solar thermal and geothermal sources.

While the heat source $Q_{in}$ may be a fluid stream of the high temperature source itself, in other embodiments the heat source $Q_{in}$ may be a thermal fluid in contact with the high temperature source. The thermal fluid may deliver the thermal energy to the waste heat exchanger 108 to transfer the energy to the working fluid in the circuit 100.

A power turbine 110 is arranged downstream from the heat exchanger 108 for receiving and expanding the first mass flow $m_1$ discharged from the heat exchanger 108. The power turbine 110 may be any type of expansion device, such as an expander or a turbine, and may be operatively coupled to an alternator, generator 112, or other device or system configured to receive shaft work. The generator 112 converts the mechanical work generated by the power turbine 110 into usable electrical power.

The power turbine 110 discharges the first mass flow $m_1$ into a first recuperator 114 fluidly coupled downstream thereof. The first recuperator 114 may be configured to transfer residual thermal energy in the first mass flow $m_1$ to the second mass flow $m_2$ which also passes through the first recuperator 114. Consequently, the temperature of the first mass flow $m_1$ is decreased and the temperature of the second mass flow $m_2$ is increased. The second mass flow $m_2$ may be subsequently expanded in a drive turbine 116.

The drive turbine 116 discharges the second mass flow $m_2$ into a second recuperator 118 fluidly coupled downstream thereof. The second recuperator 118 may be configured to transfer residual thermal energy from the second mass flow $m_2$ to the combined working fluid $m_1+m_2$ originally discharged from the main pump 104. The mass flows $m_1$, $m_2$ discharged from each recuperator 114, 118, respectively, are recombined at point 120 in the circuit 102 and then returned to a lower temperature state at a condenser 122. After passing through the condenser 122, the combined working fluid $m_1+m_2$ is returned to the main pump 104 and the cycle is started anew.

The recuperators 114, 118 and the condenser 122 may be any device adapted to reduce the temperature of the working fluid such as, but not limited to, a direct contact heat exchanger, a trim cooler, a mechanical refrigeration unit, and/or any combination thereof. The heat exchanger 108, recuperators 114, 118, and/or the condenser 122 may include or employ one or more printed circuit heat exchange panels. Such heat exchangers and/or panels are known in the art, and are described in U.S. Pat. Nos. 6,921,518; 7,022,294; and 7,033,553, the contents of which are incorporated by reference to the extent consistent with the present disclosure.

The pump 104 and drive turbine 116 may be operatively coupled via a common shaft 123, thereby forming a direct-drive turbopump 124 where the drive turbine 116 expands working fluid to drive the main pump 104. In one embodiment, the turbopump 124 is hermetically-sealed within a housing or casing 126 such that shaft seals are not needed along the shaft 123 between the main pump 104 and drive turbine 116. Eliminating shaft seals may be advantageous since it contributes to a decrease in capital costs for the heat engine system 100. Also, hermetically-sealing the turbopump 124 with the casing 126 presents significant savings by eliminating overboard working fluid leakage. In other embodiments, however, the turbopump 124 need not be hermetically-sealed.

Steady-state operation of the turbopump 124 is at least partially dependent on the mass flow and temperature of the second mass flow $m_2$ expanded within the drive turbine 116. Until the mass flow and temperature of the second mass flow $m_2$ is sufficiently increased, the main pump 104 cannot adequately drive the drive turbine 116 in self-sustaining operation. Accordingly, at heat engine system 100 startup, and until the turbopump 124 "ramps-up" and is able to adequately circulate the working fluid on its own, the heat engine system 100 uses a starter pump 128 to circulate the working fluid. The starter pump 128 may be driven by a motor 130 and operate until the temperature of the second mass flow $m_2$ is sufficient such that the turbopump 124 can "bootstrap" itself into steady-state operation.

In one or more embodiments, the heat source $Q_{in}$ may be at a temperature of approximately 200° C., or a temperature at which the turbopump 124 is able to bootstrap itself. As can be appreciated, higher heat source temperatures can be utilized, without departing from the scope of the disclosure. To keep thermally-induced stresses in a manageable range, however, the working fluid temperature can be "tempered" through the use of liquid $CO_2$ injection upstream of the drive turbine 116.

To facilitate the start sequence of the turbopump 124, the heat engine system 100 may further include a series of check valves, bypass valves, and/or shut-off valves arranged at predetermined locations throughout the circuit 102. These valves may work in concert to direct the working fluid into the appropriate conduits until turbopump 124 steady-state operation is maintained. In one or more embodiments, the various valves may be automated or semi-automated motor-driven valves coupled to an automated control system (not shown). In other embodiments, the valves may be manually-adjustable or may be a combination of automated and manually-adjustable.

For example, a shut-off valve 132 arranged upstream of the power turbine 110 may be closed during heat engine system 100 startup and ramp-up. Consequently, after being heated in the heat exchanger 108, the first mass flow $m_1$ is diverted around the power turbine 110 via a first diverter line 134 and a second diverter line 138. A bypass valve 142 is arranged in the first diverter line 134 and a bypass valve 140 is arranged in the second diverter line 138. The portion of working fluid circulated through the first diverter line 134 may be used to preheat the second mass flow $m_2$ in the first recuperator 114. A check valve 144 allows the second mass flow $m_2$ to flow through to the first recuperator 114. The portion of the working fluid circulated through the second diverter line 138 is combined with the second mass flow $m_2$ discharged from the first recuperator 114 and injected into the drive turbine 116 in its high-temperature condition.

A first check valve 146 may be arranged downstream from the main pump 104 and a second check valve 148 may be arranged downstream from the starter pump 128. The check valves 146, 148 may be configured to prevent the working fluid from flowing upstream toward the respective pumps 104, 128 during various stages of operation of the heat engine system 100. For instance, during startup and ramp-up the starter pump 128 creates an elevated head pressure downstream from the first check valve 146 (e.g., at point 150) as compared to the low pressure discharge of the main pump 104. The first check valve 146 prevents the high pressure working fluid discharged from the starter pump 128 from circulating toward the main pump 104 and thereby impeding the operational progress of the turbopump 124 as it ramps up its speed.

Until the turbopump 124 accelerates past its stall speed, where the main pump 104 can adequately pump against the head pressure created by the starter pump 128, a first recirculation line 152 may be used to divert the low pressure working fluid discharged from the main pump 104. A first bypass valve 154 may be arranged in the first recirculation line 152 and may be fully or partially opened while the turbopump 124 ramps up its speed to allow the low pressure working fluid to recirculate back to a low pressure point in the working fluid circuit 102, such as any point in the working fluid circuit 102 downstream of the power or drive turbines 110, 116 and upstream of the pumps 104, 128. In one embodiment, the first recirculation line 152 may fluidly couple the discharge of the main pump 104 to the inlet of the condenser 122, such as at point 156.

Once the turbopump 124 attains a "bootstrapping" speed (i.e., a self-sustaining speed), the bypass valve 154 in the first recirculation line 152 can be gradually closed. Gradually closing the bypass valve 154 will increase the fluid pressure at the discharge from the main pump 104 and decrease the flow rate through the first recirculation line 152. Eventually, once the turbopump 124 reaches steady-state operating speeds, the bypass valve 154 may be fully closed and the entirety of the working fluid discharged from the main pump 104 may be directed through the first check valve 146.

Once the turbopump 124 reaches steady-state operating speeds, and even once a bootstrapped speed is achieved, the shut-off valve 132 arranged upstream from the power turbine 110 may be opened and the bypass valve 140 may be simultaneously closed. As a result, the heated stream of first mass flow $m_1$ may be directed through the power turbine 110 to commence generation of electrical power.

Also, once steady-state operating speeds are achieved the starter pump 128 becomes redundant and can therefore be deactivated. To facilitate this without causing damage to the starter pump 128, a second recirculation line 158 having a second bypass valve 160 is arranged therein may direct lower pressure working fluid discharged from the starter pump 128 to a low pressure side of the working fluid circuit 102 (e.g., point 156). The low pressure side of the working fluid circuit 102 may be any point in the working fluid circuit 102 downstream of the power or drive turbines 110, 116 and upstream of the pumps 104, 128. The second bypass valve 160 is generally closed during startup and ramp-up so as to direct all the working fluid discharged from the starter pump 128 through the second check valve 148. However, as the starter pump 128 powers down, the head pressure past the second check valve 148 becomes greater than the starter pump 128 discharge pressure. In order to provide relief to the starter pump 128, the second bypass valve 160 may be gradually opened to allow working fluid to escape to the low pressure side of the working fluid circuit. Eventually, the second bypass valve 160 is completely opened as the speed of the starter pump 128 slows to a stop. Again, the valving may be regulated through the implementation of an automated control system (not shown).

As will be appreciated by those skilled in the art, there are several advantages to the embodiments disclosed herein. For example, the turbopump 124 is able to circulate the fluid to not only generate electricity via the power turbine 110 but also use fluid energy remaining in the working fluid to drive the main pump 104 via the drive turbine 116. Consequently, fluid energy is not required to be converted into mechanical work, then into electricity, and then back into mechanical work, as would be the case with a motor-driven pump. This reduces the required capacity of the generator 112 for the power turbine 110 and therefore provides cost saving on capital investment. Moreover, the turbopump 124 eliminates the need for a variable frequency drive and gearbox that would otherwise be needed for a motor-driven pump. Such components not only introduce energy loss terms and decrease overall system performance, but also increase capital costs and present additional points of failure in the heat engine system 100. Also, the design of the drive turbine 116 and pump 104 can be matched to provide a high degree of performance from a physically small pump, providing cost advantages, small system footprint, and physical arrangement flexibility.

Figure 2:
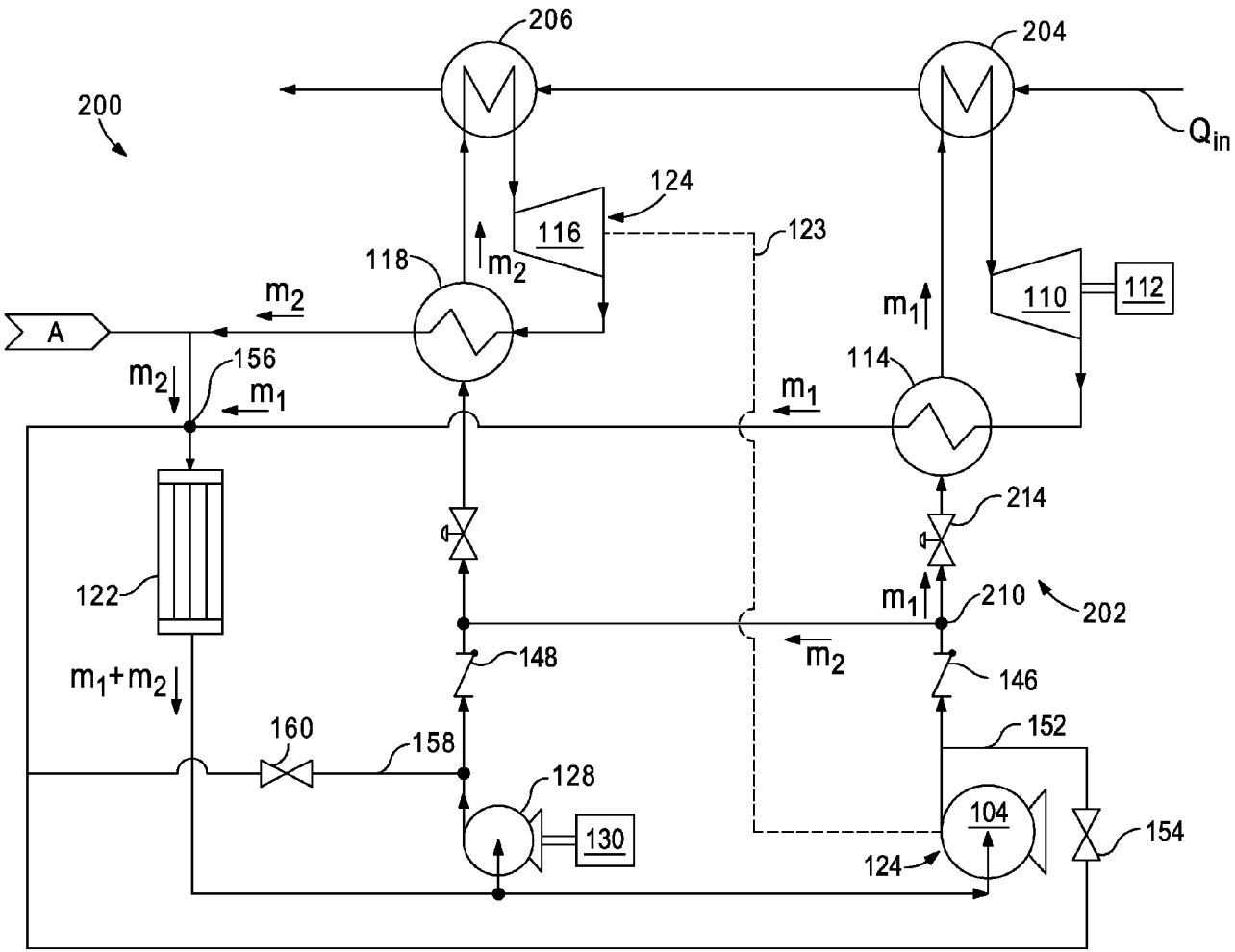
FIG. 2 illustrates a schematic of a parallel heat engine cycle, according to one or more embodiments disclosed.

Referring now to FIG. 2, an exemplary heat engine system 200 is shown wherein heat engine system 200 may be similar in several respects to the heat engine system 100 described above. Accordingly, the heat engine system 200 may be further understood with reference to FIG. 1, where like numerals indicate like components that will not be described again in detail. As with the heat engine system 100 described above, the heat engine system 200 in FIG. 2 may be used to convert thermal energy to work by thermal expansion of a working fluid mass flowing through a working fluid circuit 202. The heat engine system 200, however, may be characterized as a parallel-type Rankine thermodynamic cycle.

Specifically, the working fluid circuit 202 may include a first heat exchanger 204 and a second heat exchanger 206 arranged in thermal communication with the heat source $Q_{in}$. The first and second heat exchangers 204, 206 may correspond generally to the heat exchanger 108 described above with reference to FIG. 1. For example, in one embodiment, the first and second heat exchangers 204, 206 may be first and second stages, respectively, of a single or combined heat exchanger. The first heat exchanger 204 may serve as a high temperature heat exchanger (e.g., a higher temperature relative to the second heat exchanger 206) adapted to receive initial thermal energy from the heat source $Q_{in}$. The second heat exchanger 206 may then receive additional thermal energy from the heat source $Q_{in}$ via a serial connection downstream from the first heat exchanger 204. The heat exchangers 204, 206 are arranged in series with the heat source $Q_{in}$, but in parallel in the working fluid circuit 202.

The first heat exchanger 204 may be fluidly coupled to the power turbine 110 and the second heat exchanger 206 may be fluidly coupled to the drive turbine 116. In turn, the power turbine 110 is fluidly coupled to the first recuperator 114 and the drive turbine 116 is fluidly coupled to the second recuperator 118. The recuperators 114, 118 may be arranged in series on a low temperature side of the working fluid circuit 202 and in parallel on a high temperature side of the working fluid circuit 202. For example, the high temperature side of the working fluid circuit 202 includes the portions of the working fluid circuit 202 arranged downstream from each recuperator 114, 118 where the working fluid is directed to the heat exchangers 204, 206. The low temperature side of the working fluid circuit 202 includes the portions of the working fluid circuit 202 downstream from each recuperator 114, 118 where the working fluid is directed away from the heat exchangers 204, 206.

The turbopump 124 is also included in the working fluid circuit 202, where the main pump 104 is operatively coupled to the drive turbine 116 via the shaft 123 (indicated by the dashed line), as described above. The pump 104 is shown separated from the drive turbine 116 only for ease of viewing and describing the working fluid circuit 202. Indeed, although not specifically illustrated, it will be appreciated that both the main pump 104 and the drive turbine 116 may be hermetically-sealed within the casing 126 (FIG. 1). This also applies to FIGS. 3 and 4 below. The starter pump 128 facilitates the start sequence for the turbopump 124 during startup of the heat engine system 200 and ramp-up of the turbopump 124. Once steady-state operation of the turbopump 124 is reached, the starter pump 128 may be deactivated.

The power turbine 110 may operate at a higher relative temperature (e.g., higher turbine inlet temperature) than the drive turbine 116, due to the temperature drop of the heat source $Q_{in}$ experienced across the first heat exchanger 204. Each turbine 110, 116, however, may be configured to operate at the same or substantially the same inlet pressure. The low-pressure discharge mass flow exiting each recuperator 114, 118 may be directed through the condenser 122 to be cooled for return to the low temperature side of the working fluid circuit 202 and to either the main or starter pumps 104, 128, depending on the stage of operation.

During steady-state operation of the heat engine system 200, the turbopump 124 circulates all of the working fluid throughout the working fluid circuit 202 using the main pump 104, and the starter pump 128 does not generally operate nor is needed. The first bypass valve 154 in the first recirculation line 152 is fully closed and the working fluid is separated into the first and second mass flows $m_1$, $m_2$ at point 210. The first mass flow $m_1$ is directed through the first heat exchanger 204 and subsequently expanded in the power turbine 110 to generate electrical power via the generator 112. Following the power turbine 110, the first mass flow $m_1$ passes through the first recuperator 114 and transfers residual thermal energy to the first mass flow $m_1$ as the first mass flow $m_1$ is directed toward the first heat exchanger 204.

The second mass flow $m_2$ is directed through the second heat exchanger 206 and subsequently expanded in the drive turbine 116 to drive the main pump 104 via the shaft 123. Following the drive turbine 116, the second mass flow $m_2$ passes through the second recuperator 118 to transfer residual thermal energy to the second mass flow $m_2$ as the second mass flow $m_2$ courses toward the second heat exchanger 206. The second mass flow $m_2$ is then re-combined with the first mass flow $m_1$ and the combined mass flow $m_1+m_2$ is subsequently cooled in the condenser 122 and directed back to the main pump 104 to commence the fluid loop anew.

During startup of the heat engine system 200 or ramp-up of the turbopump 124, the starter pump 128 is engaged and operates to start the turbopump 124 spinning. To help facilitate this, a shut-off valve 214 arranged downstream from point 210 is initially closed such that no working fluid is directed to the first heat exchanger 204 or otherwise expanded in the power turbine 110. Rather, all the working fluid discharged from the starter pump 128 is directed through the second heat exchanger 206 and the drive turbine 116. The heated working fluid expands in the drive turbine 116 and drives the main pump 104, thereby commencing operation of the turbopump 124.

The head pressure generated by the starter pump 128 near point 210 prevents the low pressure working fluid discharged from the main pump 104 during ramp-up from traversing the first check valve 146. Until the main pump 104 is able to accelerate past its stall speed, the first bypass valve 154 in the first recirculation line 152 may be fully opened to recirculate the low pressure working fluid back to a low pressure point in the working fluid circuit 202, such as at point 156 adjacent the inlet of the condenser 122. Once the turbopump 124 reaches its "bootstrapped" speed (e.g., self-sustaining speed), the bypass valve 154 may be gradually closed to increase the discharge pressure of the main pump 104 and also decrease the flow rate through the first recirculation line 152. Once the turbopump 124 reaches steady-state operation, and even once a bootstrapped speed is achieved, the shut-off valve 214 may be gradually opened, thereby allowing the first mass flow $m_1$ to be expanded in the power turbine 110 to commence generating electrical energy. Again, the valving may be regulated through the implementation of an automated control system (not shown).

With the turbopump 124 operating at steady-state operating speeds, the starter pump 128 can gradually be powered down and deactivated. Deactivating the starter pump 128 may include simultaneously opening the second bypass valve 160 arranged in the second recirculation line 158. The second bypass valve 160 allows the increasingly lower pressure working fluid discharged from the starter pump 128 to escape to the low pressure side of the working fluid circuit (e.g., point 156). Eventually the second bypass valve 160 may be completely opened as the speed of the starter pump 128 slows to a stop and the second check valve 148 prevents working fluid discharged by the main pump 104 from advancing toward the discharge of the starter pump 128. At steady-state, the turbopump 124 continuously pressurizes the working fluid circuit 202 in order to drive both the drive turbine 116 and the power turbine 110.

Figure 3:
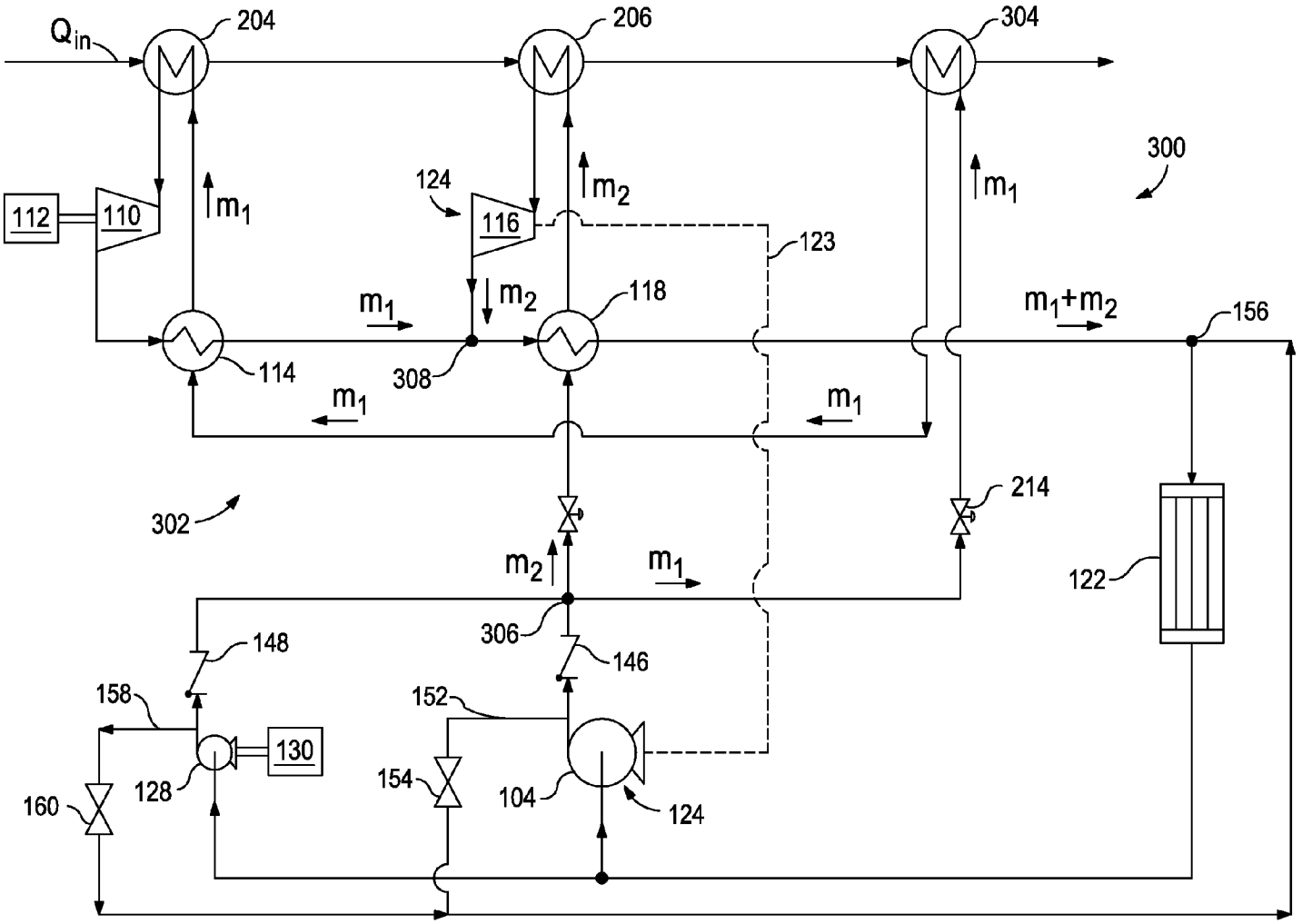
FIG. 3 illustrates a schematic of another parallel heat engine cycle, according to one or more embodiments disclosed.

FIG. 3 illustrates an exemplary parallel-type heat engine system 300, which may be similar in some respects to the above-described heat engine systems 100 and 200, and therefore, may be best understood with reference to FIGS. 1 and 2, where like numerals correspond to like elements that will not be described again. The heat engine system 300 includes a working fluid circuit 302 utilizing a third heat exchanger 304 also in thermal communication with the heat source $Q_{in}$. The heat exchangers 204, 206, 304 are arranged in series with the heat source $Q_{in}$, but arranged in parallel in the working fluid circuit 302.

The turbopump 124 (i.e., the combination of the main pump 104 and the drive turbine 116 operatively coupled via the shaft 123) is arranged and configured to operate in parallel with the starter pump 128, especially during heat engine system 300 startup and turbopump 124 ramp-up. During steady-state operation of the heat engine system 300, the starter pump 128 does not generally operate. Instead, the main pump 104 solely discharges the working fluid that is subsequently separated into first and second mass flows $m_1$, $m_2$, respectively, at point 306. The third heat exchanger 304 may be configured to transfer thermal energy from the heat source $Q_{in}$ to the first mass flow $m_1$ flowing therethrough. The first mass flow $m_1$ is then directed to the first heat exchanger 204 and the power turbine 110 for expansion power generation. Following expansion in the power turbine 110, the first mass flow $m_1$ passes through the first recuperator 114 to transfer residual thermal energy to the first mass flow $m_1$ discharged from the third heat exchanger 304 and coursing toward the first heat exchanger 204.

The second mass flow $m_2$ is directed through the second heat exchanger 206 and subsequently expanded in the drive turbine 116 to drive the main pump 104. After being discharged from the drive turbine 116, the second mass flow $m_2$ merges with the first mass flow $m_1$ at point 308. The combined mass flow $m_1+m_2$ thereafter passes through the second recuperator 118 to provide residual thermal energy to the second mass flow $m_2$ as the second mass flow $m_2$ courses toward the second heat exchanger 206.

During the heat engine system 300 startup and/or the turbopump 124 ramp-up, the starter pump 128 circulates the working fluid to commence the turbopump 124 spinning. The shut-off valve 214 may be initially closed to prevent working fluid from circulating through the first and third heat exchangers 204, 304 and being expanded in the power turbine 110. The working fluid discharged from the starter pump 128 is directed through the second heat exchanger 206 and the drive turbine 116. The heated working fluid expands in the drive turbine 116 and drives the main pump 104, thereby commencing operation of the turbopump 124.

Until the discharge pressure of the main pump 104 accelerates past its stall speed and can withstand the head pressure generated by the starter pump 128, any working fluid discharged from the main pump 104 is generally recirculated via the first recirculation line 152 back to a low pressure point in the working fluid circuit 202 (e.g., point 156). Once the turbopump 124 becomes self-sustaining, the bypass valve 154 may be gradually closed to increase the main pump 104 discharge pressure and decrease the flow rate in the first recirculation line 152. At that point, the shut-off valve 214 may also be gradually opened to begin circulation of the first mass flow $m_1$ through the power turbine 110 to generate electrical energy. Also, at this point the starter pump 128 can be gradually deactivated while simultaneously opening the second bypass valve 160 arranged in the second recirculation line 158. Eventually the second bypass valve 160 is completely opened and the starter pump 128 can be slowed to a stop. Again, the valving may be regulated through the implementation of an automated control system (not shown).

Figure 4:
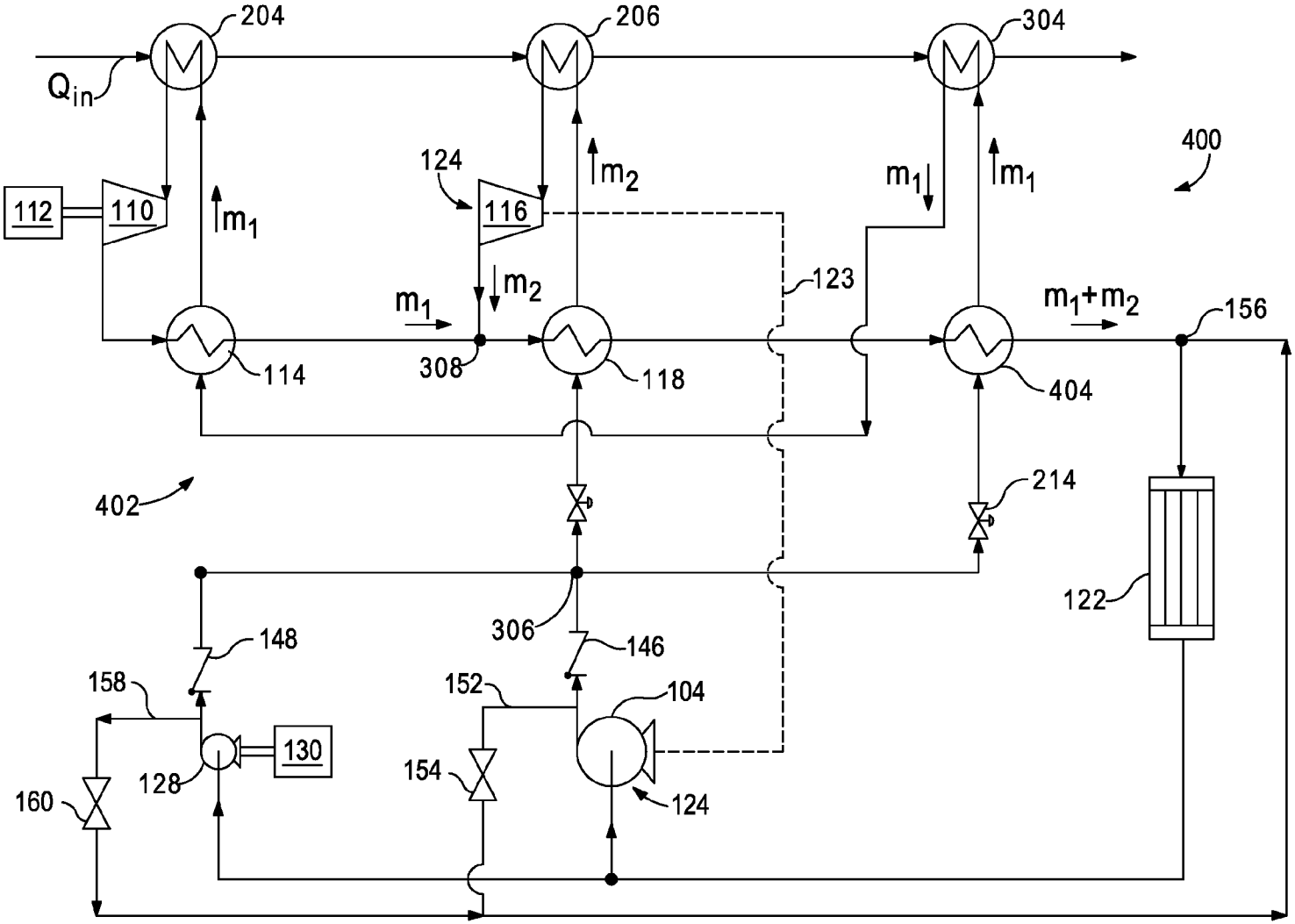
FIG. 4 illustrates a schematic of another parallel heat engine cycle, according to one or more embodiments disclosed.

FIG. 4 illustrates an exemplary parallel-type heat engine system 400, wherein the heat engine system 400 may be similar to the system 300 above, and as such, may be best understood with reference to FIG. 3 where like numerals correspond to like elements that will not be described again. The working fluid circuit 402 in FIG. 4 is substantially similar to the working fluid circuit 302 of FIG. 3 but with the exception of an additional, third recuperator 404 adapted to extract additional thermal energy from the combined mass flow $m_1+m_2$ discharged from the second recuperator 118. Accordingly, the temperature of the first mass flow $m_1$ entering the third heat exchanger 304 may be preheated in the third recuperator 404 prior to receiving thermal energy transferred from the heat source $Q_{in}$.

As illustrated, the recuperators 114, 118, 404 may operate as separate heat exchanging devices. In other embodiments, however, the recuperators 114, 118, 404 may be combined as a single, integral recuperator. Steady-state operation, system startup, and turbopump 124 ramp-up may operate substantially similar as described above in FIG. 3, and therefore will not be described again.

Each of the described heat engine systems 100, 200, 300, and 400, as depicted in FIGS. 1-4, may be implemented in a variety of physical embodiments, including but not limited to fixed or integrated installations, or as a self-contained device such as a portable waste heat engine "skid." The waste heat engine skid may be configured to arrange each working fluid circuit 102, 202, 302, and 402 and related components (e.g., turbines 110, 116, recuperators 114, 118, 404, condenser 122, pumps 104, 128, etc.) in a consolidated, single unit. An exemplary waste heat engine skid is described and illustrated in U.S. application Ser. No. 12/631,412, entitled "Thermal Energy Conversion Device," filed on Dec. 4, 2009, and published as U.S. 2011-0185729, the contents of which are hereby incorporated by reference to the extent consistent with the present disclosure.

Figure 5:
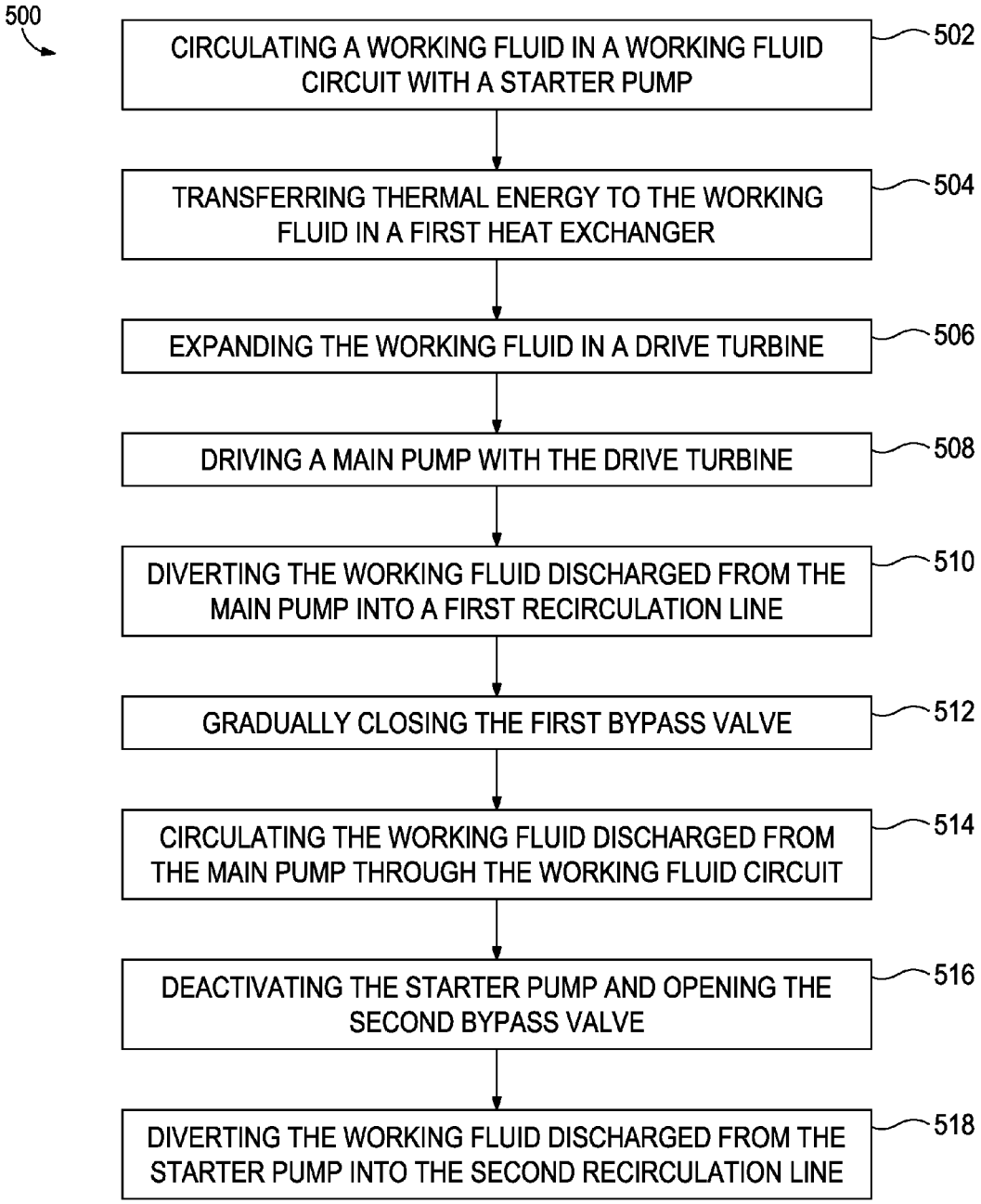
FIG. 5 is a flowchart of a method for starting a turbopump in a thermodynamic working fluid circuit, according to one or more embodiments disclosed.

Referring now to FIG. 5, illustrated is a flowchart of a method 500 for starting a turbopump in a thermodynamic working fluid circuit. The method 500 includes circulating a working fluid in the working fluid circuit with a starter pump, as at 502. The starter pump may be in fluid communication with a first heat exchanger, and the first heat exchanger may be in thermal communication with a heat source. Thermal energy is transferred to the working fluid from the heat source in the first heat exchanger, as at 504. The method 500 further includes expanding the working fluid in a drive turbine, as at 506. The drive turbine is fluidly coupled to the first heat exchanger, and the drive turbine is operatively coupled to a main pump, such that the combination of the drive turbine and main pump is the turbopump.

The main pump is driven with the drive turbine, as at 508. Until the main pump accelerates past its stall point, the working fluid discharged from the main pump is diverted into a first recirculation line, as at 510. The first recirculation line may fluidly communicate the main pump with a low pressure side of the working fluid circuit. Moreover, a first bypass valve may be arranged in the first recirculation line. As the turbopump reaches a self-sustaining speed of operation, the first bypass valve may gradually begin to close, as at 512. Consequently, the main pump begins circulating the working fluid discharged from the main pump through the working fluid circuit, as at 514.

The method 500 may also include deactivating the starter pump and opening a second bypass valve arranged in a second recirculation line, as at 516. The second recirculation line may fluidly communicate the starter pump with the low pressure side of the working fluid circuit. The low pressure working fluid discharged from the starter pump may be diverted into the second recirculation line until the starter pump comes to a stop, as at 518.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method for starting a turbopump in a working fluid circuit, comprising:

circulating a working fluid in the working fluid circuit with a starter pump, the working fluid comprising carbon dioxide and the starter pump being in fluid communication with a first heat exchanger in thermal communication with a heat source;

transferring thermal energy to the working fluid from the heat source in the first heat exchanger;

expanding the working fluid in a drive turbine in fluid communication with the first heat exchanger, wherein the turbopump comprises the drive turbine operatively coupled to a main pump;

driving the main pump with the drive turbine;

diverting the working fluid discharged from the main pump into a first recirculation line disposed in the working fluid circuit, the first recirculation line having a first bypass valve arranged therein;

closing the first bypass valve as the turbopump reaches a self-sustaining speed of operation;

circulating the working fluid discharged from the main pump through the working fluid circuit;

deactivating the starter pump and opening a second bypass valve arranged in a second recirculation line disposed in the working fluid circuit; and diverting the working fluid discharged from the starter pump into the second recirculation line.

2. The method of claim 1, wherein circulating the working fluid in the working fluid circuit with the starter pump is preceded by closing a shut-off valve to divert the working fluid around a power turbine arranged in the working fluid circuit.

3. The method of claim 2, further comprising:

opening the shut-off valve once the turbopump reaches the self-sustaining speed of operation, thereby directing the working fluid into the power turbine;

expanding the working fluid in the power turbine; and driving a generator operatively coupled to the power turbine to generate electrical power.

4. The method of claim 2, further comprising:

opening the shut-off valve once the turbopump reaches the self-sustaining speed of operation;

directing the working fluid into a second heat exchanger fluidly coupled to the power turbine and in thermal communication with the heat source;

transferring additional thermal energy from the heat source to the working fluid in the second heat exchanger;

expanding the working fluid received from the second heat exchanger in the power turbine; and driving a generator operatively coupled to the power turbine, whereby the generator is operable to generate electrical power.

5. The method of claim 2, further comprising:

opening the shut-off valve once the turbopump reaches the self-sustaining speed of operation;

directing the working fluid into a second heat exchanger in thermal communication with the heat source;

directing the working fluid from the second heat exchanger into a third heat exchanger fluidly coupled to the power turbine and in thermal communication with the heat source, wherein the first heat exchanger, the second heat exchanger, and the third heat exchanger are fluidly arranged in series with the heat source;

transferring additional thermal energy from the heat source to the working fluid in the third heat exchanger;

expanding the working fluid received from the third heat exchanger in the power turbine; and driving a generator operatively coupled to the power turbine, whereby the generator is operable to generate electrical power.

6. A heat engine system, comprising:

a working fluid comprising carbon dioxide;

a working fluid circuit containing the working fluid and at least a portion of the working fluid circuit is configured to contain the working fluid in a supercritical state;

a turbopump comprising a main pump and a drive turbine operatively coupled together and hermetically-sealed within a casing, the main pump being configured to circulate the working fluid throughout the working fluid circuit;

a starter pump fluidly arranged in parallel with the main pump in the working fluid circuit;

a first check valve arranged in the working fluid circuit downstream of the main pump;

a power turbine fluidly coupled to both the main pump and the starter pump via the working fluid circuit;

a shut-off valve arranged in the working fluid circuit to divert the working fluid around the power turbine;

a condenser fluidly coupled to the working fluid circuit, disposed downstream of at least one recuperator and upstream of the main pump and the starter pump, and configured to remove thermal energy from the working fluid;

a first recirculation line disposed downstream of the main pump and upstream of the condenser within the working fluid circuit; and a second recirculation line disposed downstream of the starter pump and upstream of the condenser within the working fluid circuit.

7. The heat engine system of claim 6, further comprising a second check valve arranged in the working fluid circuit downstream of the starter pump.

8. The heat engine system of claim 6, wherein the at least one recuperator comprises:

a first recuperator fluidly coupled to the power turbine via the working fluid circuit; and a second recuperator fluidly coupled to the drive turbine via the working fluid circuit.

9. The heat engine system of claim 8, further comprising a third recuperator fluidly coupled to the second recuperator via the working fluid circuit, wherein the first recuperator, the second recuperator, and the third recuperator are fluidly arranged in series within the working fluid circuit.

10. The heat engine system of claim 6, further comprising a first heat exchanger, a second heat exchanger, and a third heat exchanger configured to be fluidly arranged in series and in thermal communication with a heat source and the first heat exchanger and the second heat exchanger are fluidly arranged in parallel within the working fluid circuit.

11. The heat engine system of claim 6, wherein the working fluid is in a supercritical state within working fluid circuit downstream from the power turbine and the drive turbine and upstream of the starter pump and the main pump.

12. A heat engine system, comprising:

a working fluid comprising carbon dioxide;

a working fluid circuit containing the working fluid and separating the working fluid into a first mass flow and a second mass flow, and at least a portion of the working fluid circuit is configured to contain the working fluid in a supercritical state;

a turbopump comprising a main pump and a drive turbine operatively coupled together and arranged within a casing, the main pump being configured to circulate the working fluid throughout the working fluid circuit and the drive turbine being configured to expand the working fluid;

a starter pump fluidly arranged in parallel with the main pump in the working fluid circuit;

a first heat exchanger in fluid communication with the main pump via the working fluid circuit and configured to be in thermal communication with a heat source, the first heat exchanger receiving the first mass flow and configured to transfer thermal energy from the heat source to the first mass flow;

a second heat exchanger in fluid communication with the main pump and the starter pump via the working fluid circuit and configured to be in thermal communication with the heat source, the second heat exchanger receiving the second mass flow and configured to transfer thermal energy from the heat source to the second mass flow;

a power turbine fluidly coupled to the first heat exchanger via the working fluid circuit and configured to expand the first mass flow;

a first recuperator fluidly coupled to the power turbine via the working fluid circuit and receiving the first mass flow discharged from the power turbine;

a condenser fluidly coupled to the working fluid circuit downstream of the first recuperator and upstream of the main pump and configured to remove thermal energy from the working fluid;

a first recirculation line disposed downstream of the main pump and upstream of the condenser within the working fluid circuit; and a second recirculation line disposed downstream of the starter pump and upstream of the condenser within the working fluid circuit.

13. The heat engine system of claim 12, wherein the first heat exchanger and the second heat exchanger are configured to be fluidly arranged in series and in thermal communication with the heat source and the first heat exchanger and the second heat exchanger are fluidly arranged in parallel within the working fluid circuit.

14. The heat engine system of claim 12, wherein the first recuperator is configured to transfer residual thermal energy from the first mass flow to the second mass flow upstream of the drive turbine for the second mass flow.

15. The heat engine system of claim 12, wherein the first recuperator is configured to transfer residual thermal energy from the first mass flow discharged from the power turbine to the first mass flow directed to the first heat exchanger.

16. The heat engine system of claim 12, further comprising a second recuperator fluidly coupled to the drive turbine via the working fluid circuit and configured to receive the working fluid discharged from the drive turbine.

17. The heat engine system of claim 16, wherein the second recuperator is configured to transfer residual thermal energy from the second mass flow to a combination of the first and second mass flows.

18. The heat engine system of claim 16, wherein the second recuperator is configured to transfer residual thermal energy from the second mass flow discharged from the drive turbine to the second mass flow directed to the second heat exchanger.

19. The heat engine system of claim 12, wherein the working fluid is in a supercritical state within working fluid circuit downstream from the power turbine and the drive turbine and upstream of the starter pump and the main pump.

20. The heat engine system of claim 1, further comprising:

a first bypass valve arranged in the first recirculation line; and a second bypass valve arranged in the second recirculation line.

* * * * *